United States Patent [19]

Eckles et al.

[11] 4,134,803

[45] Jan. 16, 1979

[54] NITROGEN AND SULFUR COMPOSITIONS AND ACID COPPER PLATING BATHS

[75] Inventors: William E. Eckles, Cleveland Heights; Thomas W. Starinshak, Berea, both of Ohio

[73] Assignee: R. O. Hull & Company, Inc., Cleveland, Ohio

[21] Appl. No.: 862,940

[22] Filed: Dec. 21, 1977

[51] Int. Cl.[2] ..... C07C 153/00; C07C 155/00; C25D 3/38

[52] U.S. Cl. ..... 204/52 R; 204/DIG. 2; 252/182; 260/453 RW; 260/455 A

[58] Field of Search ..... 260/455 A, 453 RW; 204/52 R, DIG. 2; 252/182

[56] References Cited

U.S. PATENT DOCUMENTS

| | | | |
|---|---|---|---|
| 2,849,351 | 8/1958 | Gündel et al. | 204/52 R X |
| 3,023,215 | 2/1962 | Gündel | 260/455 A X |
| 3,101,305 | 8/1963 | Roth et al. | 204/52 R |
| 3,122,549 | 2/1964 | Gündel | 260/455 A X |
| 3,359,297 | 12/1967 | Gündel | 260/455 A |
| 3,414,493 | 12/1968 | Nobel et al. | 204/52 R |
| 3,725,220 | 4/1973 | Kessler et al. | 204/52 R |
| 3,784,454 | 1/1974 | Lyde | 204/52 R |
| 3,798,138 | 3/1974 | Ostrow et al. | 204/52 R |
| 4,038,161 | 7/1977 | Eckles et al. | 204/52 R |

*Primary Examiner*—G. L. Kaplan
*Attorney, Agent, or Firm*—Maky, Renner, Otto & Boisselle

[57] ABSTRACT

Nitrogen and sulfur compositions are described which are useful in aqueous acidic plating baths and processes for electrodepositing bright and level copper coatings. The compositions are prepared by reacting a mixture of (a) a disulfide having the formula $$[RR'NCS_2]_2 \qquad \text{(Formula I)}$$

wherein R and R′ are each independently hydrogen, alkyl or aryl groups, and (b) a halo hydroxy sulfonic acid having the formula $$X(CH_2)_nCHOH—CH_2SO_3M \qquad \text{(Formula II)}$$

wherein X is a halogen, n is one or two and M is hydrogen or an alkali metal, in (c) an aqueous alkaline medium.

Particularly bright and level deposits are obtained when the reaction mixture used to form the composition also contains an aliphatic aldehyde containing up to three carbon atoms. The presence of the above-described brightening and leveling agents in acid copper plating baths produces a lustrous, smooth and level deposit of copper over a wide range of current densities, particularly when wetting agents are included in the plating baths.

40 Claims, No Drawings

NITROGEN AND SULFUR COMPOSITIONS AND ACID COPPER PLATING BATHS

BACKGROUND OF THE INVENTION

This invention relates to new compositions and to improvements in the electrodeposition of copper from aqueous acidic copper plating baths, preferably from aqueous acidic copper plating baths containing one or more bath-soluble copper salts, free acid and chloride ions.

Acid copper plating baths for producing a brilliant copper finish on articles have been known in the art, and a number of patents have described various brightening agents which can be added to acidic baths. Examples of such patents include U.S. Pat. Nos. 2,707,166; 2,707,167, 2,830,014; 3,276,979 and 3,288,690. In U.S. Pat. No. 3,725,220, it has been suggested that the utilization of organic sulfonates or carboxylates as brightening additives in acid aqueous copper plating baths results in improved stability of the bath and effective deposition of copper over a satisfactory current density range.

In a number of instances in the prior art acid copper plating baths, a sufficiently brilliant finish is obtained but little or no smoothing effect on the surface is obtained. The ability of a plating bath to produce deposits relatively thicker in small recesses and relatively thinner on small protrusions thereby decreasing the depth of surface irregularities is known as "leveling."For example, a copper plating bath with satisfactory leveling ability can be utilized to reduce or eliminate the effect of microscopic cracks or scratches on the surfaces of the articles being plated. Accordingly, a number of additives have been described in the prior art for increasing the leveling effect of acid copper plating baths. For example, U.S. Pat. No. 3,101,305 describes a leveling additive obtained from the condensation of thiourea with aliphatic aldehyde such as formaldehyde. Since the additives which have been described in the prior art are useful either as brightening agents or leveling agents, it generally has been necessary to utilize two additives in acid copper plating baths, one for brighteners and another for leveling. U.S. Pat. No. 4,038,161 is an example of a patent which describes the use of two additives in acid copper plating baths. One type of brightener compound disclosed in U.S. Pat. No. 4,038,161 to be used in combination with a leveling agent is the dithiocarbamic acid derivatives of the formula $$R_1R_2NCS_2—(CH_2)_n—X$$

wherein $R_1$ and $R_2$ are hydrogen, aliphatic or aromatic groups, n is an integer from one to ten, and X is a hydroxyl group, a carboxyl group, a sulfonic acid group or an alkali metal salt of the carboxyl or sulfonic acid groups. U.S. Pat. No. 3,414,493 also describes brightener compositions for copper plating baths, and one of the types of brightener composition can be presented by the formula $$R_3R_4NCS_2CH_2O(CH_2)_nSO_3M$$

wherein $R_3$ and $R_4$ are alkyl radicals, n is an integer from 3 to 8, and M is hydrogen, sodium or potassium.

SUMMARY OF THE INVENTION

The present invention comprises novel nitrogen and sulfur compositions, acid copper plating baths containing said compositions, and an improved process for depositing bright and level copper deposits from aqueous acid copper plating baths. More particularly, this invention relates to new compositions prepared by reacting a mixture of (a) a disulfide having the formula $$[RR'NCS_2]_2 \qquad \text{(Formula I)}$$

wherein R and R′ are each independently hydrogen, alkyl or aryl groups, and (b) a halo hydroxy sulfonic acid having the formula $$X(CH_2)_nCHOH—CH_2SO_3M \qquad \text{(Formula II)}$$

wherein X is a halogen, n is one or two and M is hydrogen or an alkali metal, in (c) an aqueous alkaline medium.

These compositions are effective particularly as leveling and brightening agents for acid copper plating baths, and when incorporated into copper plating baths, result in an improved level and bright copper deposit over a wide current density range.

DESCRIPTION OF THE PREFERRED EMBODIMENTS

The nitrogen and sulfur compositions of the invention are prepared by reacting a mixture of a disulfide and a halo hydroxysulfonic acid in the presence of an aqueous alkaline medium. The disulfides which are useful have the formula $$[RR'NCS_2]_2 \qquad \text{(Formula I)}$$

wherein R and R′ are each independently hydrogen, alkyl or aryl groups. The alkylgroups may contain from 1 to about 5 carbon atoms although alkyl groups containing 1 or 2 carbon atoms are preferred. In a more preferred embodiment, both R and R′ are alkyl groups containing 1 or 2 carbon atoms, that is, the disulfide is either bis(dimethylthiocarbamoyl) disulfide or bis(diethylthiocarbamoyl) disulfide.

The halo hydroxysulfonic acid utilized in the preparation of the compositions of the invention has the formula $$X(CH_2)_nCHOH—CH_2SO_3M \qquad \text{(Formula II)}$$

wherein X is a halogen, n is one or two and M is hydrogen or an alkali metal. Examples of sulfonic acids represented by Formula II include 3-chloro-2-hydroxypropyl sulfonic acid; 3-bromo-2-hydroxypropyl sulfonic acid; 4-chloro-2-hydroxybutyl sulfonic acid; 4-bromo-2-hydroxybutyl sulfonic acid; and the alkali metal salts of the sulfonic acids such as sodium 3-chloro-2-hydroxypropyl sulfonate. The sodium salts of the chlorosulfonic acids preferably are used in the reaction mixture since these are commercially available or easily prepared.

The above described thiocarbamoyl disulfides and halo hydroxysulfonic acids are reacted in an aqueous alkaline medium. The aqueous medium may be either water or a water:alcohol mixture wherein the alcohol may be methanol, ethanol, propanol, etc. The aqueous medium contains an alkali metal hydroxide such as sodium hydroxide or potassium hydroxide. The amounts of the compounds added to the aqueous medium can be varied although it is preferred that the mole ratio of disulfide:sulfonic acid:metal hydroxide be about 0.5:1:1. This reaction mixture is heated at the reflux temperature for a period of time which depends upon the particular reactants included in the mixture. Generally, a period of from about 0.5 to 4 or 5 hours is sufficient to insure complete reaction.

In another embodiment of the invention, an aliphatic aldehyde is added to the aqueous reaction mixture described above. The aliphatic aldehyde may contain up to about 3 carbon atoms and may be formaldehyde, acetaldehyde or proprionaldehyde. Formaldehyde or paraformaldehyde are preferred examples of the aliphatic aldehydes which are useful in the preparation of the compositions of the invention. When included in the mixture, the aliphatic aldehyde is charged to the reaction mixture prior to heating to the reflux temperature. The amount of aliphatic aldehyde incorporated into the mixture may be varied, but it is preferred that about 1 mole of aliphatic aldehyde be included in the mixture containing about ½ mole of the disulfide. Thus, a preferred embodiment of the invention utilizes a mixture of disulfide, sulfonic acid, aliphatic aldehyde and alkali metal hydroxide in a molar ratio of about 0.5:1:1:1. The reaction mixture containing the aliphatic aldehyde is refluxed for a period of time which depends also on the type of reactants included in the mixture. Generally, from about 178 to about 5 or 6 hours at the reflux temperature of the mixture is sufficient to insure complete reaction.

The following examples illustrate preparation of the nitrogen and sulfur compositions of the invention. Unless otherwise indicated, all parts and percentages are by weight.

EXAMPLE 1

A mixture of 14.8 parts of bis(N,N-diethylthiocarbamoyl) disulfide, 4.0 parts of sodium hydroxide, 8.2 parts of formaldehyde, 19.7 parts of the sodium salt of 3-chloro-2-hydroxypropyl sulfonic acid and 65 parts of water is prepared, stirred and heated to the reflux temperature for about 4 hours. The reaction product is cooled and diluted with water or a water methanol mixture as desired.

EXAMPLE 2

The procedure of Example 1 is repeated except that the formaldehyde is not included in the reaction mixture and 73.2 parts of water are used.

EXAMPLE 3

The procedure of Example 1 is repeated except that the disulfide used in this example is bis(N,N-dimethylthiocarbamoyl) disulfide.

EXAMPLE 4

The procedure of Example 1 is repeated except that the propyl sulfonic acid salt is replaced by an equivalent amount of the sodium salt of 4-chloro-2-hydroxybutyl sulfonic acid.

EXAMPLE 5

The procedure of Example 1 is repeated except that the formaldehyde is replaced by an equivalent amount of acetaldehyde.

The nitrogen and sulfur compositions of the present invention such as those described above, are useful additives in conventional acid copper plating baths, and when present in such baths result in a bright and level copper deposit. When the compositions of the invention are utilized which are prepared from a mixture of the type described above wherein the aliphatic aldehyde is included, the copper deposits obtained from such baths are fully bright and level, and the degree of leveling is improved over those compositions wherein the aliphatic aldehyde is omitted.

The conventional acid copper plating baths to which the compositions of this invention can be added should normally contain one or more bath-soluble copper salts, free acid and chloride ions. Copper sulfate, $CuSO_4.5H_2O$ is most often utilized as a source of copper, while sulfuric acid is the most common source of free acid. Other acids which have been utilized in the art include sulfamic or fluoboric acids, and the copper may be combined with an acid as copper carbamate or as a salt of sulfamic or fluoboric acid. The concentration of copper salt may be within the range of from about 165 to about 250 gms. and the free acid concentration can be between 45 to about 75 gms. per liter of plating bath. In addition, the baths often will contain from about 0.03 to about 0.1 gm. of chloride ions per liter of plating bath, added to the bath as hydrochloric acid.

The amount of the nitrogen and sulfur composition of the invention incorporated into the copper plating baths of the invention will be that amount required to provide the desired bright and level deposit. In general, the amount of additive required will range from about 0.001 to about 1.0 gm. per liter, although a range of from about 0.01 gm. to about 0.15 gm. per liter provides desirable bright and level deposits.

The incorporation of one or more wetting or surface active agents into the additive compositions and acid copper plating baths of the invention also results in a copper plating with improved leveling and brightness, and the additive compositions and plating baths exhibit improved stability.

Polyoxyalkylated naphthols are one type of wetting agent found to be useful in improving the quality of the copper deposits. Amounts of the substituted naphthol of up to about 1 gm. per liter and preferably from about 0.2 to about 0.8 gm. per liter provide improved copper deposits.

The polyoxyalkylated naphthols useful in the baths of this invention are obtained by reacting a naphthol with an alkylene oxide such as ethylene oxide and propylene oxide and more particularly, with from about 6 to about 40 moles of ethylene oxide per mole of naphthol. The naphthol reactant may be either $\alpha$-or $\beta$-naphthol and the naphthalene ring may contain various substituents such as the alkyl groups or alkoxy groups, especially lower alkyl and lower alkoxy groups of up to seven carbon atoms each, so long as the polyoxyalkylated naphthol remains bath-soluble. When present, there usually will not be more than two such substituents per polyoxyalkylated naphthol; that is, two lower alkoxy groups, two lower alkyl groups, or a lower alkyl or a lower alkoxy groups. The preferred polyoxyalkylated naphthols are ethoxylated naphthols having the formula

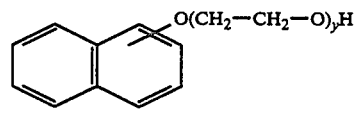

(Formula III)

wherein y is from about 6 to about 40 and preferably from about 8 to about 20.

Wetting agents based on ethylene oxide, for example, polyglycol compounds and the like, and sulfonated wetting agents also are useful. In general, the nonionic wetting agents such as those containing ether linkages are particularly useful additives, Examples of such ether-containing wetting agents are those having the general formula $$R—O—(CH_2CH_2O)_nH$$

wherein R is an aryl or alkyl group containing from about six to 20 carbon atoms and n is an integer between 2 and 100. Such wetting agents are produced generally by treating fatty alcohols or alkyl-substituted phenols with excess ethylene oxide. The alkyl carbon chain may contain from about 14 to 24 carbon atoms and may be derived from alcohol such as oleyl alcohol or stearyl alcohol.

Amine, alkanol amines, amides and polyglycol-type wetting agents known in the art are also useful. One type of amine wetting agent found particularly useful when combined with the nitrogen and sulfur composition of the invention in a copper plating bath is the group obtained by the addition of a mixture of propylene oxide and ethylene oxide to diamines. More specifically, compounds formed by the addition of propylene oxide to ethylene diamine followed by the addition of ethylene oxide are useful and are available commercially from BASF Wyandotte Ind. Chemical Group under the general trade designation "Tetronic".

Carbowax-type wetting agents which are polyethylene glycols having different molecular weights have been found to give good results. For example Carbowax No. 1000 has a molecular weight range of from about 950 to 1,050 and contains from 20 to 24 ethoxy units per molecule. Carbowax No. 4000 has a molecular weight range of from about 3000 to 3700 and contains from 68 to 85 ethoxy units per molecule. Other known nonionic glycol derivatives such as polyalkylene glycol ethers and methoxy polyethylene glycols which are available commercially can be utilized as wetting agents in the compositions of the invention. The amount of wetting agent incorporated into the compositions will depend upon types and amounts of other ingredients in the compositions, but generally from 0 to about 5 grams and preferably from 0.4 to about 1.5 grams per liter of the wetting agent may be incorporated into the compositions.

An example of a conventional acid copper plating bath to which the additives of the invention can be added is as follows:

| Conventional Bath | |
|---|---|
| Copper sulfate ($CuSO_4 . 5H_2O$) | 210 g/l |
| Sulfuric acid | 60 g/l |
| Chloride ion | 60 ppm |
| Water | 730 g/l |

The following specific examples illustrate the utility of the nitrogen and sulfur compositions of the invention as additives in copper plating baths. Sample baths of the invention are prepared from the above conventional bath by adding the additions specified in Table I and in the amounts recited.

TABLE I

| Additive/Bath | Plating Bath/ Additive Combinations[1] A | B | C | D |
|---|---|---|---|---|
| Product of Example 1 | 0.08 | — | — | — |
| Product of Example 2 | — | 0.08 | 0.08 | 0.08 |
| Polyethylene Glycol Wetting Agent (Carbowax 4000) | 1.5 | — | — | 1.5 |
| Product of β Naphthol with 10 moles ethylene oxide | — | 0.08 | — | 0.8 |
| Product of ethylene diamine PrO and EtO (Tetronic 304) | — | — | 0.4 | — |

[1]gms per liter of bath

The utility of the above described copper plating baths is illustrated with a plating test conducted in a 267 ml. air-agitated Hull Cell at an operating current of 2 amperes for 5 minutes at room temperature. The copper is deposited on a scratched brass Hull Cell panel. The copper plating baths of the type described in Table I produced a bright, smooth and level deposit of copper over a current density range of from between 100 to 2 amps/ft.sq.

In practice, the improved acid copper plating baths containing the brightener and leveling compounds of the invention are operated on a continuous or intermittent basis and from time to time, the components of the bath have to be replenished. The various components may be added singularly as required or may be added in combination. An example of a combination additive composition for acid copper plating baths within the present invention comprises an aqueous or water:alcohol mixture of (a) one or more bath soluble nitrogen and sulfur compositions of the invention which are described above, and (b) one or more wetting agents of the type described above. The relative amounts of the two or more ingredients in the additive compositions may be varied over a wide range depending on the nature and the performance of the acid copper plating bath to which the composition is added. An example of such additive composition comprises from about 10 to about 20 parts by weight of the nitrogen and sulfur composition of the invention, from about 2 to about 10 parts by weight of one or more wetting agents, preferably dissolved in water. In practice, the amounts of the compounds in the additive composition or concentrates will be such that when they are diluted and added to the baths, they will provide the requisite amounts of the components in the bath or the requisite amounts of the components required to replenish the bath.

I, therefore, particularly point out and distinctly claim as my invention:

1. A nitrogen and sulfur composition prepared by reacting a mixture of (a) a disulfide having the formula $$[RR'NCS_2]_2 \qquad \text{(Formula I)}$$

wherein R and R' are each independently hydrogen, alkyl or aryl groups, (b) a halo hydroxy sulfonic acid having the formula $$X(CH_2)_nCHOH—CH_2SO_3M \qquad \text{(Formula II)}$$

wherein X is a halogen, n is one or two and M is hydrogen or an alkali metal, and (c) an aliphatic aldehyde having up to three carbon atoms, in (d) an aqueous alkaline medium.

2. The composition of claim 1 wherein R and R′ are each independently alkyl radicals containing from one to five carbon atoms.

3. The composition of claim 1 wherein X is chlorine.

4. The composition of claim 1 wherein n is one.

5. The composition of claim 1 wherein the aliphatic aldehyde is formaldehyde or paraformaldehyde.

6. The composition of claim 1 wherein the mole ratio of disulfide to sulfonic acid to aldehyde is about 0.5:1:1.

7. The composition of claim 6 wherein the alkaline medium contains about 1 mole of an alkali metal hydroxide per mole of sulfonic acid.

8. A nitrogen and sulfur composition prepared by heating a mixture comprising (a) a disulfide having the formula $$[RR'NCS_2]_2 \quad \text{(Formula I)}$$

wherein R and R′ are each independently lower alkyl groups containing up to about 5 carbon atoms, (b) a halo hydroxy sulfonic acid having the formula $$XCH_2CHOHCH_2SO_3M$$

wherein X is a halogen and M is hydrogen or an alkali metal, and (c) an aliphatic aldehyde having up to three carbon atoms, in (d) an aqueous alkaline medium.

9. The composition of claim 8 wherein the aliphatic aldehyde is formaldehyde or paraformaldehyde.

10. The composition of claim 8 wherein the aqueous alkaline medium comprises an alkali metal hydroxide dissolved in water or an alcohol:water mixture.

11. The composition of claim 10 wherein the mole ratio of disulfide to sulfonic acid to aldehyde to hydroxide is about 0.5:1:1:1.

12. A method of electrodepositing copper coatings on a substrate which comprises electroplating said substrate in an aqueous acidic bath comprising one or more bath-soluble copper salts, free acid, and at least one bath soluble organic brightener composition prepared by reacting a mixture of (a) a disulfide having the formula $$[RR'NCS_2]_2 \quad \text{(Formula I)}$$

wherein R and R′ are each independently hydrogen, alkyl or aryl groups, (b) a halo hydroxy sulfonic acid having the formula $$X(CH_2)_nCHOH—CH_2SO_3M \quad \text{(Formula II)}$$

wherein X is a halogen, n is one or two and M is hydrogen or an alkali metal, and (c) an aliphatic aldehyde containing up to three carbon atoms, in (d) an aqueous alkaline medium.

13. The method of claim 12 wherein the aliphatic aldehyde is formaldehyde or paraformaldehyde.

14. The method of claim 13 wherein the aqueous alkaline medium comprises an alkali metal hydroxide dissolved in water or an alcohol:water mixture.

15. The method of claim 14 wherein the mole ratio of disulfide to sulfonic acid to aldehyde to hydroxide is about 0.5:1:1:1.

16. The method of claim 12 wherein the aqueous acidic bath contains the organic brightener composition in an amount which is sufficient to provide a level and bright copper electrodeposit on the substrate.

17. The method of claim 16 wherein the brightener is present in the bath in an amount at least about 0.001 gm. per liter.

18. The method of claim 12 wherein the bath also contains a wetting agent.

19. The method of claim 18 wherein the wetting agent is a polyoxyalkylated naphthol.

20. The method of claim 19 wherein the polyoxyalkylated naphthol is derived from a beta naphthol.

21. The method of claim 18 wherein the polyoxyalkylated naphthol has the formula

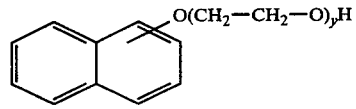

wherein y is from about 6 to about 40.

22. The method of claim 18 wherein the wetting agent is a polyoxyalkylene glycol or a polyoxyalkylene glycol ether.

23. The method of claim 22 wherein the wetting agent is a polyethylene oxide having a molecular weight of from about 400 to about 6,000.

24. The method of claim 18 wherein the wetting agent is a composition prepared by the addition of propylene oxide to ethylene diamine followed by the addition of ethylene oxide.

25. An aqueous acidic copper electroplating bath containing one or more bath-soluble copper salts, free acid, chloride ions and an effective amount of one or more bath-soluble organic brightener compounds prepared by reacting a mixture of (a) a disulfide having the formula $$[RR'NCS_2]_2 \quad \text{(Formula I)}$$

wherein R and R′ are each independently hydrogen, alkyl or aryl groups, (b) a halo hydroxy sulfonic acid having the formula $$X(CH_2)_nCHOH—CH_2SO_3M \quad \text{(Formula II)}$$

wherein X is a halogen, n is one or two and M is hydrogen or an alkali metal, and (c) an aliphatic aldehyde containing up to three carbon atoms, in (d) an aqueous alkaline medium.

26. The copper plating bath of claim 25 wherein R and R′ in the disulfide are each independently alkyl radicals containing from 1 to about 5 carbon atoms.

27. The copper plating bath of claim 25 wherein X is chlorine and n is 1.

28. The copper plating bath of claim 25 wherein the aliphatic aldehyde is formaldehyde or paraformaldehyde.

29. The copper plating bath of claim 25 wherein the aqueous alkaline solution comprises an alkali metal hydroxide dissolved in water or an alcohol:water mixture.

30. The copper plating bath of claim 29 wherein the mole ratio of disulfide to sulfonic acid to aldehyde to hydroxide is about 0.5:1:1:1.

31. The copper plating bath of claim 25 wherein the bath also contains at least one wetting agent.

32. The copper plating bath of claim 31 wherein the wetting agent is a polyoxyalkylated naphthol.

33. The copper plating bath of claim 32 wherein the polyoxyalkylated naphthol has the formula

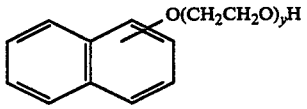

wherein y is from about 6 to about 40.

34. The copper plating bath of claim 31 wherein the wetting agent is a polyalkylene glycol, a polyalkylene glycol ether, a composition prepared by addition of propylene oxide to ethylene diamine followed by the addition of ethylene oxide or mixtures thereof.

35. The copper plating bath of claim 34 wherein the wetting agent is a polyethylene oxide having a molecular weight of from about 400 to about 6,000.

36. The copper plating bath of claim 25 wherein the brightener composition is present in the bath in an amount from about 0.001 to about 1.0 gm. per liter.

37. An aqueous acid copper electroplating bath for producing bright and level copper deposits comprising per liter of bath from about (a) 165 to 250 grams of copper sulfate,
(b) 45 to about 75 grams of sulfuric acid,
(c) 0.03 to about 0.1 gram of chloride ion,
(d) 0.01 to about 1.0 gram of the composition of claim 3,
(e) 0 to about 2.0 gram of a polyalkyline glycol ether wetting agent,
(f) 0 to about 2 grams of an ethoxylated beta-naphthol, and
(g) 0 to about 2 gram of a composition prepared by addition of propylene oxide to ethylene diamine followed by the addition of ethylene oxide.

38. An additive composition for aqueous acidic copper electroplating baths comprising an aqueous mixture of (a) one or more bath-soluble leveling compositions of claim 1, and
(b) a polyalkylene glycol or polyalkylene glycol ether wetting agent.

39. The additive composition of claim 38 wherein the composition also contains an ethoxylated beta-naphthol.

40. An additive composition for aqueous acidic copper electroplating baths comprising an aqueous mixture of (a) one or more bath-soluble compositions of claim 1, and
(b) a composition prepared by the addition of propylene oxide to ethylene diamine followed by the addition of ethylene oxide.

* * * * *